US009162464B2

(12) United States Patent
Mano

(10) Patent No.: US 9,162,464 B2
(45) Date of Patent: Oct. 20, 2015

(54) LIQUID EJECTING APPARATUS AND WIPING METHOD

(71) Applicant: SEIKO EPSON CORPORATION, Tokyo (JP)

(72) Inventor: Takashi Mano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/446,224

(22) Filed: Jul. 29, 2014

(65) Prior Publication Data

US 2015/0035900 A1 Feb. 5, 2015

(30) Foreign Application Priority Data

Jul. 31, 2013 (JP) ..... 2013-158649

(51) Int. Cl.
*B41J 2/165* (2006.01)

(52) U.S. Cl.
CPC ..... *B41J 2/16538* (2013.01)

(58) Field of Classification Search
CPC ..... B41J 2/16541
USPC ..... 347/33, 1
See application file for complete search history.

(56) References Cited

U.S. PATENT DOCUMENTS

| | | | | |
|---|---|---|---|---|
| 5,614,930 | A * | 3/1997 | Osborne et al. | 347/33 |
| 6,155,666 | A * | 12/2000 | Sugimoto et al. | 347/24 |
| 7,380,903 | B2 * | 6/2008 | Kachi | 347/33 |
| 2002/0105560 | A1 * | 8/2002 | Shimizu et al. | 347/29 |
| 2007/0103505 | A1 | 5/2007 | Takagi | |
| 2007/0165063 | A1 | 7/2007 | Horie | |
| 2007/0188545 | A1 * | 8/2007 | Miyamoto | 347/33 |
| 2011/0292100 | A1 * | 12/2011 | Takeda et al. | 347/1 |
| 2013/0307900 | A1 * | 11/2013 | Harada | 347/31 |

FOREIGN PATENT DOCUMENTS

| | | |
|---|---|---|
| JP | 09-085958 | 3/1997 |
| JP | 2007-152940 | 6/2007 |
| JP | 2007-190818 | 8/2007 |
| JP | 2007-276424 | 10/2007 |

* cited by examiner

*Primary Examiner* — Stephen Meier
*Assistant Examiner* — John P Zimmermann
(74) *Attorney, Agent, or Firm* — Workman Nydegger

(57) ABSTRACT

A liquid ejecting apparatus includes a liquid ejecting unit which includes a nozzle forming surface having nozzle openings for ejecting liquid formed thereon, a wiper which is contactably disposed on the nozzle forming surface, a movement unit which is able to relatively move the liquid ejecting unit and the wiper, and a control unit which controls the movement units such that an interference amount of the wiper and the nozzle forming surface in a position of the wiper which comes in contact with the liquid ejecting unit, is smaller than an interference amount of the wiper and the nozzle forming surface when the wiper is relatively moved through a nozzle region which is a region including the nozzle openings of the nozzle forming surface in a direction along the nozzle forming surface.

9 Claims, 6 Drawing Sheets

LIQUID EJECTING APPARATUS AND WIPING METHOD

BACKGROUND

1. Technical Field

The present invention relates to, for example, a liquid ejecting apparatus such as an ink jet-type printer, and a wiping method in the liquid ejecting apparatus.

2. Related Art

In general, as one type of a liquid ejecting apparatus, an ink jet-type printer in which printing is performed by ejecting ink (liquid) from a nozzle having an opening formed on a nozzle forming surface of a liquid ejecting head (a liquid ejecting unit) onto a recording medium such as paper is known. In such a printer, in order to maintain ejection properties of the ink from the liquid ejecting head, a head maintenance apparatus is generally provided.

Such a head maintenance apparatus is provided with various functions. For example, a function in which a nozzle forming surface of a liquid ejecting head is capped by a suction cap, and thickened ink is sucked from a nozzle by a suction pump, thereby allowing the ejection properties of the ink from the nozzle to be recovered is provided. In addition, a function in which unnecessary ink adhered to the nozzle forming surface of the liquid ejecting head is swept away (wiped away) by a wiper is provided.

Among these functions, the function of sweeping away the ink by the wiper is performed by the head maintenance apparatus. Furthermore, as a printer which is provided with a head maintenance apparatus having a function of sweeping away ink by a wiper, a printer of the related art as disclosed in JP-A-2007-152940 is known.

In such a printer, a head main body (a liquid ejecting head) is supported by a holder, and a wiper is moved in a wiping direction while coming in contact with an ink discharge surface (a nozzle forming surface) of the head main body, thereby allowing ink adhered to the ink discharge surface to be captured and swept away by the wiper.

Meanwhile, in the printer as described above, a vertical position of the wiper is generally set such that an interference amount of the wiper with respect to the ink discharge surface is an interference amount which is suitable for sweeping the ink discharge surface. Furthermore, when the wiper is moved in the wiping direction in order to sweep away the ink adhered to the ink discharge surface by the wiper, first, the wiper comes in contact with the holder for supporting the head main body, and thus is stroked by the corner portion of the holder, and the wiper is moved to a corner portion of the head main body while being bent in a direction which is inverse to the wiping direction, and then the wiper is further moved to the ink discharge surface while being stroked by the corner portion of the head main body. For this reason, the wiper is stroked by the corner portion of the holder or the corner portion of the head main body, so that a problem in which the ink adhered to the wiper is adhered to a side surface of the holder or the head main body occurs.

Furthermore, these problems are not limited to an ink jet-type printer but are substantially common to liquid ejecting apparatuses provided with a wiper for sweeping away liquid adhered to a nozzle forming surface of a liquid ejecting head.

SUMMARY

An advantage of some aspects of the invention is to provide a liquid ejecting apparatus and a wiping method by which a nozzle forming surface is effectively wiped by a wiper while liquid adhered to the wiper is inhibited from being adhered to a liquid ejecting unit side.

Hereinafter, means of the invention and operation effects thereof will be described.

According to an aspect of the invention, there is provided a liquid ejecting apparatus including: a liquid ejecting unit which includes a nozzle forming surface having nozzle openings for ejecting liquid formed thereon; a wiper which is contactably disposed on the nozzle forming surface; a first movement unit which is able to relatively move the liquid ejecting unit and the wiper in a first direction along the nozzle forming surface; a second movement unit which is able to relatively move the liquid ejecting unit and the wiper in a second direction intersecting with the nozzle forming surface; and a control unit which controls the first movement unit and the second movement unit, in which the control unit controls the first movement unit such that the wiper comes in contact with the nozzle forming surface, and the wiper is relatively moved from one end to the other end of the nozzle forming surface in the first direction while the wiper comes in contact with the nozzle forming surface, and the control unit controls the second movement unit such that a first interference amount which is an interference amount of the wiper and the nozzle forming surface in the second direction in a position of the wiper which comes in contact with the liquid ejecting unit, is smaller than a second interference amount which is an interference amount of the wiper and the nozzle forming surface in the second direction when the wiper is relatively moved through a nozzle region which is a region including the nozzle openings of the nozzle forming surface in the first direction.

According to this aspect, the interference amount of the wiper and the nozzle forming surface in the position (the end portion of the nozzle forming surface) of the wiper which comes in contact with the liquid ejecting unit is the first interference amount which is smaller than the second interference amount, and thus the wiper is inhibited from being stroked in the position of the wiper which comes in contact with the liquid ejecting unit. For this reason, the liquid adhered to the wiper is inhibited from being adhered to the liquid ejecting unit side. On the other hand, since the interference amount of the wiper and the nozzle forming surface in the nozzle region of the nozzle forming surface is the second interference amount which is greater than the first interference amount, the nozzle forming surface is effectively wiped by the wiper. Therefore, it is possible to effectively wipe the nozzle forming surface by the wiper while the liquid adhered to the wiper is inhibited from being adhered to the liquid ejecting unit side.

In the liquid ejecting apparatus described above, it is preferable that the control unit control the second movement unit such that the interference amount of the wiper and the nozzle forming surface in the second direction is changed from the first interference amount to the second interference amount, between the one end and the nozzle region of the nozzle forming surface in the first direction.

According to this aspect, in particular, it is possible to effectively wipe the nozzle region of the nozzle forming surface by the wiper.

In the liquid ejecting apparatus described above, a scraping unit which is disposed in the other end side of the nozzle forming surface of the liquid ejecting unit away from the nozzle forming surface in the first direction to scrape off the liquid adhered to the wiper by coming in contact with the wiper is further included, the control unit controls the first movement unit such that the wiper is relatively moved to the scraping unit side in the first direction after the wiper passes through the other end of the nozzle forming surface in the first direction, and the control unit controls the second movement unit such that the interference amount of the wiper and the nozzle forming surface in the second direction is changed to a third interference amount which is greater than the second interference amount, between the other end of the nozzle forming surface and the scraping unit in the first direction.

According to this aspect, a contact amount of the wiper and the scraping unit becomes larger, and thus it is possible to effectively scrape off and collect the liquid adhered to the wiper by the scraping unit.

In the liquid ejecting apparatus described above, it is preferable that the control unit control the first movement unit such that relative movement of the liquid ejecting unit and the wiper in the first direction is stopped, between the one end and the nozzle region of the nozzle forming surface in the first direction, and then the control unit control the second movement unit such that the interference amount of the wiper and the nozzle forming surface in the second direction is changed from the first interference amount to the second interference amount.

According to this aspect, it is possible to change the interference amount of the wiper and the nozzle forming surface from the first interference amount to the second interference amount with high accuracy.

According to another aspect of the invention, there is provided a wiping method in which a liquid ejecting unit including a nozzle forming surface having nozzle openings for ejecting liquid formed thereon and a wiper are relatively moved to wipe the nozzle forming surface by sliding the wiper and the nozzle forming surface, in which a first interference amount which is an interference amount of the wiper and the nozzle forming surface in a position of the wiper which comes in contact with the liquid ejecting unit, is smaller than a second interference amount which is an interference amount of the wiper and the nozzle forming surface when the wiper and a nozzle region which is a region including the nozzle openings of the nozzle forming surface are slid.

According to this aspect, the interference amount of the wiper and the nozzle forming surface in the position (the end portion of the nozzle forming surface) of the wiper which comes in contact with the liquid ejecting unit is the first interference amount which is smaller than the second interference amount, and thus the wiper is inhibited from being stroked in the position of the wiper which comes in contact with the liquid ejecting unit. For this reason, the liquid adhered to the wiper is inhibited from being adhered to the liquid ejecting unit side. On the other hand, since the interference amount of the wiper and the nozzle forming surface in the nozzle region of the nozzle forming surface is the second interference amount which is greater than the first interference amount, the nozzle forming surface is effectively wiped by the wiper. Therefore, it is possible to effectively wipe the nozzle forming surface by the wiper while the liquid adhered to the wiper is inhibited from being adhered to the liquid ejecting unit side.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which a liquid ejecting apparatus is specified as an ink jet-type printer will be described with reference to the drawings.

Figure 1:
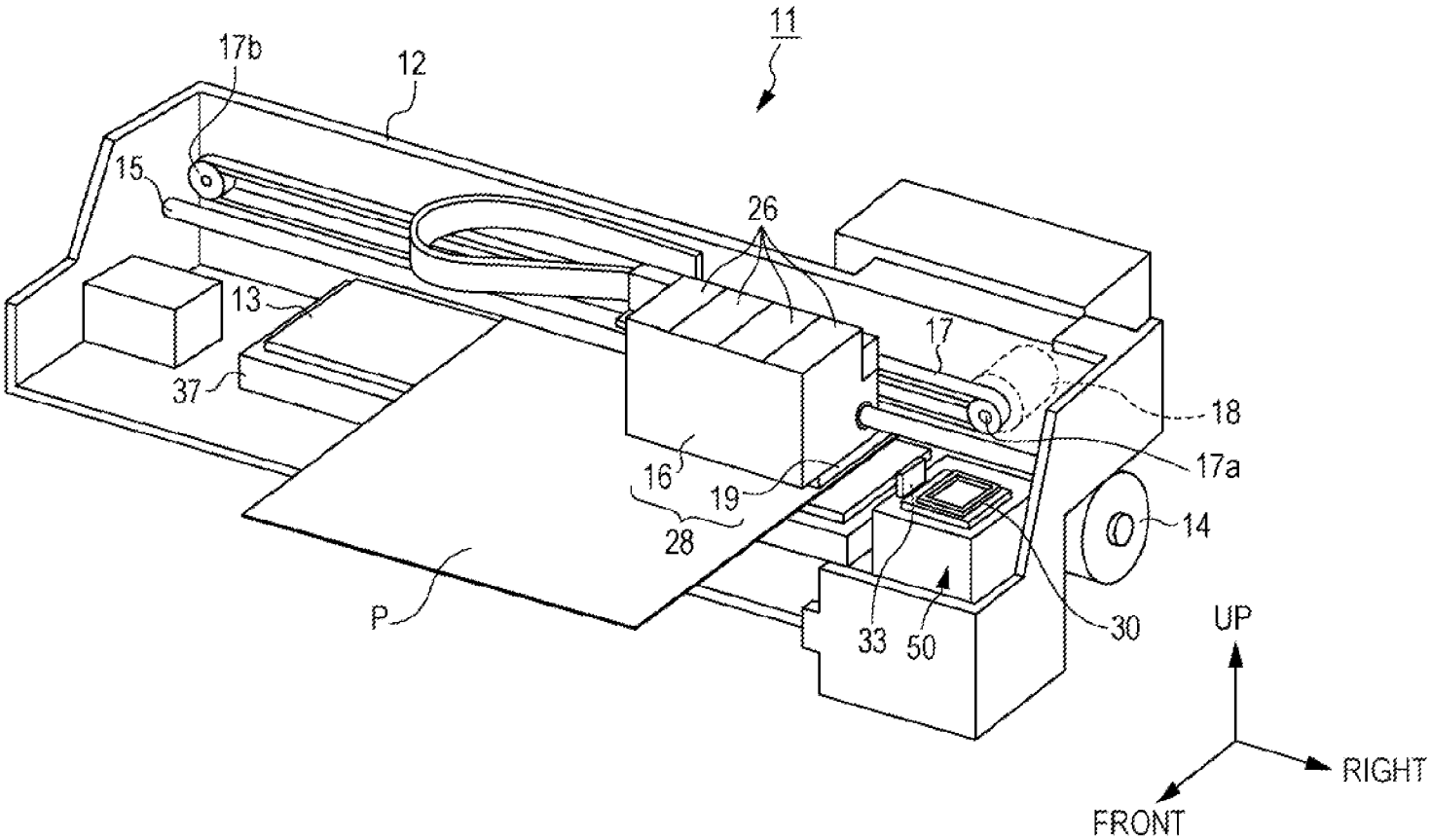
FIG. 1 is a perspective view of an ink jet-type printer of an embodiment.

As illustrated in FIG. 1, an ink jet-type printer 11 as an example of a liquid ejecting apparatus includes a substantially box-shaped main body case 12 which is in the shape of a substantially rectangular box. In a lower portion inside the main body case 12, a pedestal 13 extends along a horizontal direction which is a longitudinal direction of the pedestal 13. On the pedestal 13, paper P is transported by a paper feed mechanism (not illustrated) from a backward side, on the basis of driving of a paper feed motor 14 provided in a lower portion of a back surface of the main body case 12.

In an upper portion of the pedestal 13 inside the main body case 12, a guide shaft 15 extends along the horizontal direction which is the longitudinal direction of the pedestal 13. The guide shaft 15 supports a carriage 16 such that the carriage 16 is able to be reciprocated along the guide shaft 15. In positions corresponding to both end portions of the guide shaft 15 of an inner surface of a back wall of the main body case 12, a drive pulley 17*a* and a driven pulley 17*b* are rotatably supported.

The drive pulley 17*a* is connected to an output shaft of a carriage motor 18 as an example of a first movement unit which is driving source when the carriage 16 is reciprocated in the horizontal direction as an example of a first direction. An endless timing belt 17, of which a portion is connected to the carriage 16 is wound between a pair of pulleys 17*a* and 17*b*.

Therefore, by driving the carriage motor 18, the carriage 16 is moved in the horizontal direction by the endless timing belt 17 while being guided by the guide shaft 15. Furthermore, the carriage 16 is provided with a linear encoder 29 (refer to FIG. 4) for detecting a position of the carriage 16.

Figure 2:
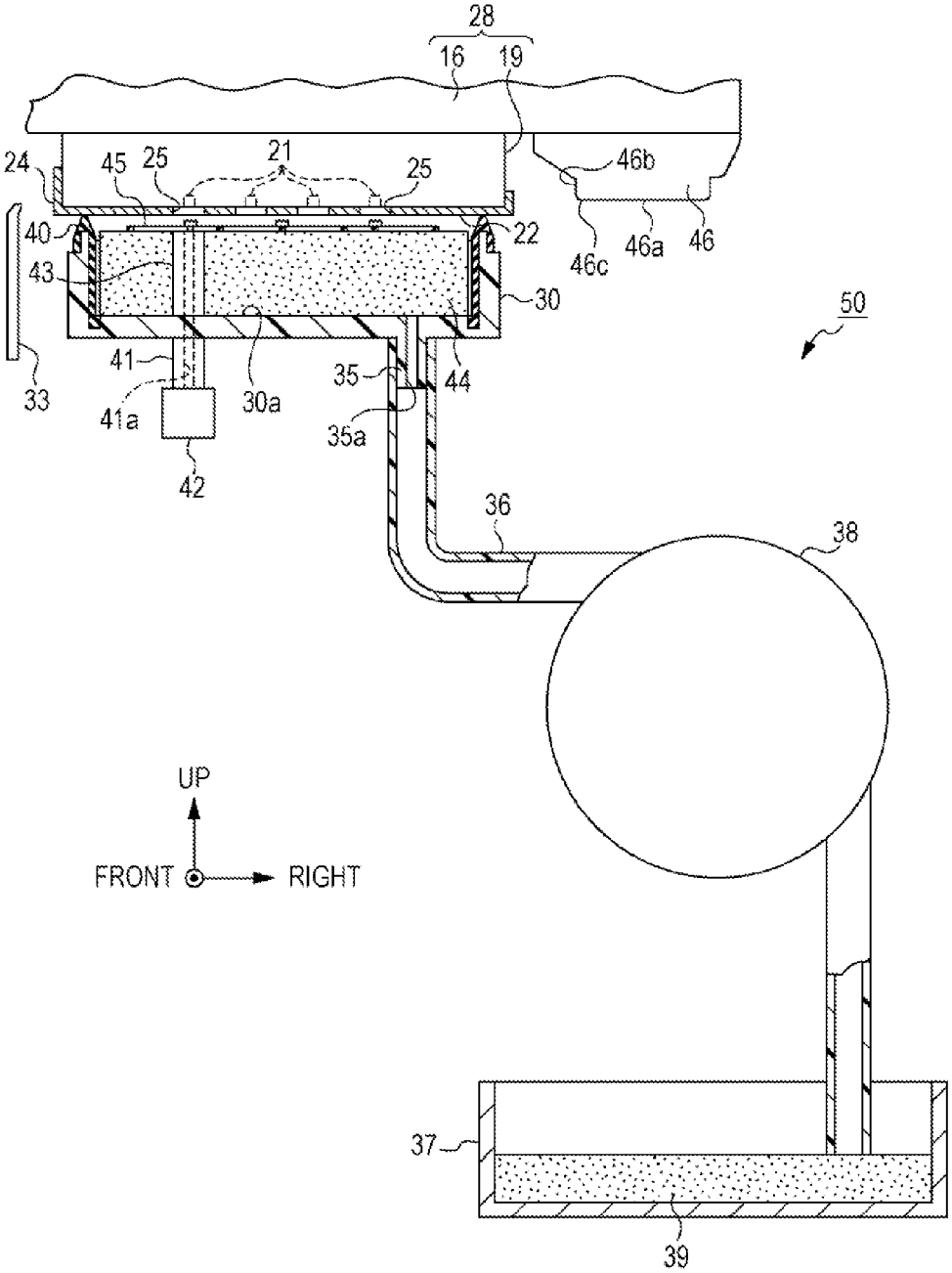
FIG. 2 is a schematic sectional view of a maintenance mechanism of the printer.
Figure 3:
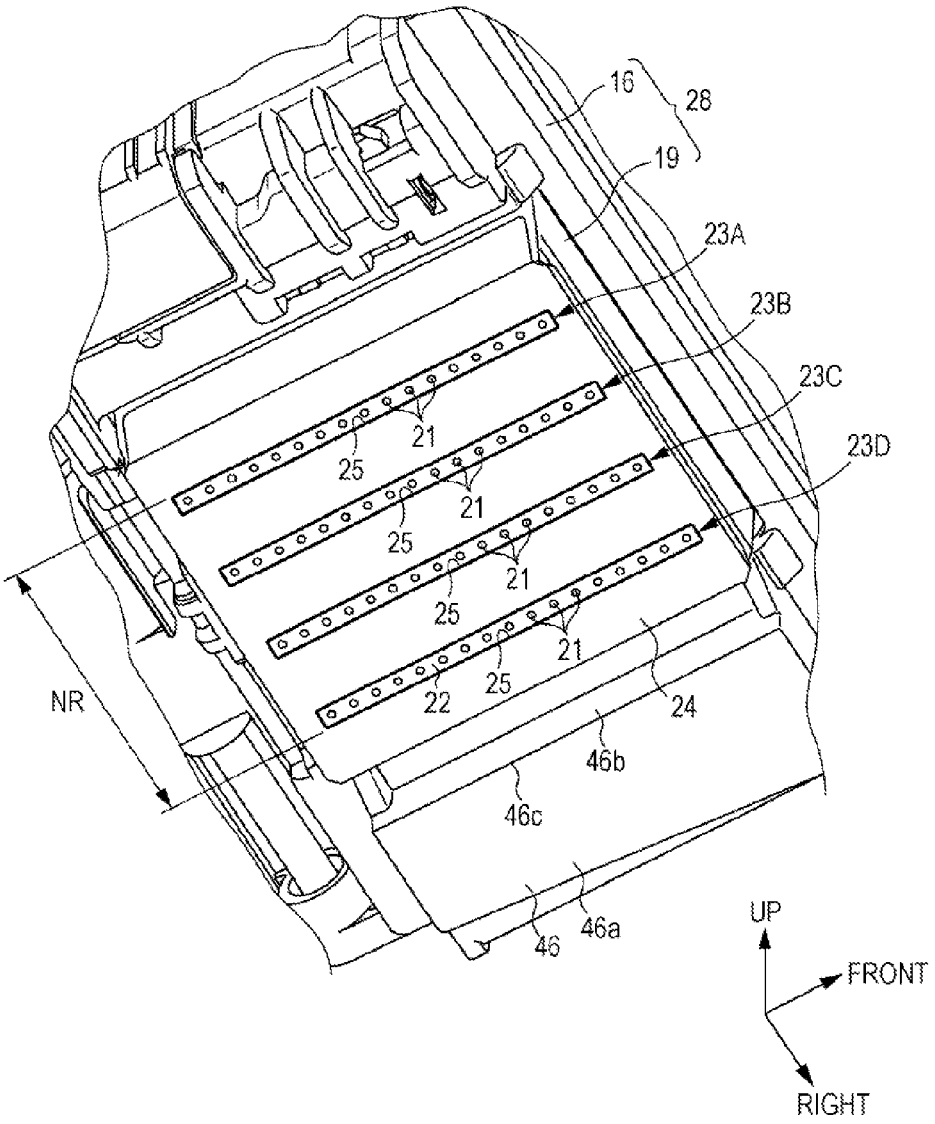
FIG. 3 is an enlarged perspective view of a main part of a liquid ejecting unit of the printer.

As illustrated in FIG. 2 and FIG. 3, on a lower end portion of the carriage 16, a liquid ejecting head 19 is supported by a head lifting mechanism 20 (refer to FIG. 4) as an example of a second movement unit such that the liquid ejecting head 19 is able to be lifted. On a rectangular-shaped lower surface of the liquid ejecting head 19, a nozzle forming surface 22 on which openings of a plurality of nozzles 21 are formed is provided.

In a middle portion of the nozzle forming surface 22, a plurality of nozzle rows (in this embodiment, 4 rows) configured by the plurality of nozzles 21 which are parallel in a front/rear direction are arranged at an equal interval in the horizontal direction. These 4 nozzle rows are a nozzle row 23A, a nozzle row 23B, a nozzle row 23C, and a nozzle row 23D in sequence from left to right.

In addition, a rectangular plate-shaped cover head 24 for covering the entire nozzle forming surface 22 is attached to the liquid ejecting head 19. Both left and right end portions of the cover head 24 are bent and come in contact with both left and right side surfaces of the liquid ejecting head 19, respectively.

In positions corresponding to the respective nozzle rows 23A to 23D of the cover head 24, cover opening portions 25 for causing each of the nozzle rows 23A to 23D to be exposed are formed, respectively. Furthermore, a region including the opening of each of the nozzles 21 of the nozzle forming surface 22, that is, a region from the nozzle row 23A to the nozzle row 23D of the nozzle forming surface 22 is a nozzle region NR.

As illustrated in FIG. 1 and FIG. 2, a plurality of ink cartridges 26 (in this embodiment, 4 ink cartridges) for supplying ink as liquid to the liquid ejecting head 19 is attachably/detachably provided on the carriage 16, respectively. Ink having different colors from each other is contained in each of the ink cartridges 26, and supplied to the liquid ejecting head 19 from the ink cartridges 26 by driving a piezoelectric element 27 (refer to FIG. 4) provided in the liquid ejecting head 19, respectively.

Furthermore, the ink supplied to the liquid ejecting head 19 is ejected from the plurality of nozzles 21 (refer to FIG. 2) formed on the nozzle forming surface 22 (refer to FIG. 2) of the liquid ejecting head 19 onto the paper P which is transported onto the pedestal 13, thereby allowing the paper P to be printed upon. Furthermore, in this embodiment, the carriage 16 and the liquid ejecting head 19 constitute a liquid ejecting unit 28.

In addition, in a home position region (a non-printing region) which does not correspond to the paper P positioned in the left end portion inside the main body case 12, a maintenance mechanism 50 which performs maintenance such as cleaning or wiping of the liquid ejecting head 19 when printing is not performed is provided.

Next, the maintenance mechanism 50 will be described.

As illustrated in FIG. 2, the maintenance mechanism 50 is provided with a square bottomed box-shaped cap 30 which is able to contain the ink ejected from the liquid ejecting head 19, and a cap lifting mechanism 32 (refer to FIG. 4) for lifting the cap 30. The cap 30 is provided with a seal member 40 consisting of a square frame-shaped elastomer in order to cover an inner side surface and an upper end portion of the cap 30.

Furthermore, while the carriage 16 is moved to the home position region, the cap 30 is lifted by the cap lifting mechanism 32 (refer to FIG. 4), and thus comes in contact with the cover head 24 attached to the liquid ejecting head 19 such that the cap 30 covers the respective nozzles 21. That is, the cap 30 comes in contact with the nozzle forming surface 22 through the cover head 24 such that the cap 30 covers the respective nozzles 21.

In addition, the maintenance mechanism 50 includes a substantially rectangular plate-shaped wiper 33 which is disposed on a left side of the cap 30, and able to wipe (sweep) the nozzle forming surface 22 of the liquid ejecting head 19, and a wiper lifting mechanism 34 (refer to FIG. 4) as an example of the second movement unit for lifting the wiper 33. The wiper 33 consists of a flexible material such as a gum, or an elastomer.

Furthermore, while the liquid ejecting head 19 is lowered by the head lifting mechanism 20 (refer to FIG. 4) to a position of the nozzle forming surface 22 which is able to interfere with the wiper 33, the carriage 16 is moved toward the left side which is a printing region side for performing the printing from a right side which is the home position region side, thereby allowing the nozzle forming surface 22 to be wiped by the wiper 33.

In a right-hand position of a bottom wall of the cap 30, a first protrusion 35 protrudes downwardly. In the first protrusion 35, a discharge passage 35*a* for discharging the ink from the cap 30 is formed such that the discharge passage 35*a* penetrates in a vertical direction. There is a discharge tube 36 formed by a flexible material, of which an upstream side that is a base end side of the discharge tube 36 is connected to the first protrusion 35, and of which a downstream side that is a tip end side of the discharge tube 36 is inserted into a cuboid-shaped waste ink tank 37.

In a middle portion of the discharge tube 36 between the cap 30 and the waste ink tank 37, a tube pump 38 for performing suction with respect to an inside of the cap 30 from the cap 30 side to the waste ink tank 37 side is provided.

Furthermore, while the cap 30 comes in contact with the nozzle forming surface 22 of the liquid ejecting head 19 through the cover head 24 in order to cover the respective nozzles 21, the tube pump 38 is driven. Then, thickened ink from each of the nozzles 21 is sucked along with air bubbles or the like, and discharged into the waste ink tank 37 through the inside of the cap 30, the discharge passage 35*a*, and an inside of the discharge tube 36, that is, a so-called cleaning is performed. Furthermore, a waste ink absorber 39 which absorbs and stores the discharged ink in the waste ink tank 37 is contained in the waste ink tank 37.

In addition, in a left-hand position of the bottom wall of the cap 30, a second protrusion 41 protrudes downwardly. In the second protrusion 41, an atmospheric relief passage 41*a* for relieving a pressure inside the cap 30 to that of the atmosphere is formed such that the atmospheric relief passage 41*a* penetrates in the vertical direction. In a lower end that is a tip end of the second protrusion 41, an atmospheric relief valve 42 is provided. Furthermore, when the atmospheric relief valve 42 opens, the inside of the atmospheric relief passage 41*a* is made to communicate with the atmosphere, and when the atmospheric relief valve 42 is closed, the inside of the atmospheric relief passage 41*a* is blocked from the atmosphere.

At a position corresponding to the second protrusion 41 on an inner bottom surface 30*a* of the cap 30, a cylinder-shaped atmospheric relief tube 43, of which an inner portion communicates with the atmospheric relief passage 41*a* is erectly provided. An upper end of the atmospheric relief tube 43 opens in the cap 30. Inside the cap 30, a rectangular plate-shaped porous liquid absorber 44 which is able to absorb the ink is contained.

Inside the cap 30, a stainless-steel regulation member 45 is disposed on an upper surface of the liquid absorber 44 which is a surface facing the nozzle forming surface 22. The regulation member 45 regulates contact of the liquid absorber 44 with respect to the nozzle forming surface 22 of the liquid ejecting head 19 and the cover head 24 by swelling the liquid absorber 44 to be deformed or floating the liquid absorber 44. Furthermore, the height of the upper surface of the regulation member 45 is lower than the height of the upper end surface of the seal member 40 of the cap 30.

As illustrated in FIG. 2 and FIG. 3, in the home position region side which is the right side of the liquid ejecting head 19 on the lower surface of the carriage 16, a scraping unit 46 for scraping off the ink which is adhered to the wiper 33 when the nozzle forming surface 22 is wiped by the wiper 33, by coming in contact with the wiper 33 is provided. That is, the scraping unit 46 is disposed at the right end side of the nozzle forming surface 22 away from the nozzle forming surface 22 in the horizontal direction.

The scraping unit 46 includes a flat rectangular-shaped lower surface 46*a*, and a rectangular-shaped scraping surface 46*b* which is a left side surface facing the right side surface of the liquid ejecting head 19. Therefore, in a boundary of the lower surface 46*a* and the scraping surface 46*b* of the scraping unit 46, a corner portion 46*c* is formed such that the corner portion 46*c* extends in the front/rear direction which is a direction orthogonal to a movement direction of the carriage 16. Furthermore, the lower surface 46*a* of the scraping unit 46 is positioned at a slightly higher position than the nozzle forming surface 22.

Next, an electrical configuration of the ink jet-type printer 11 will be described.

Figure 4:
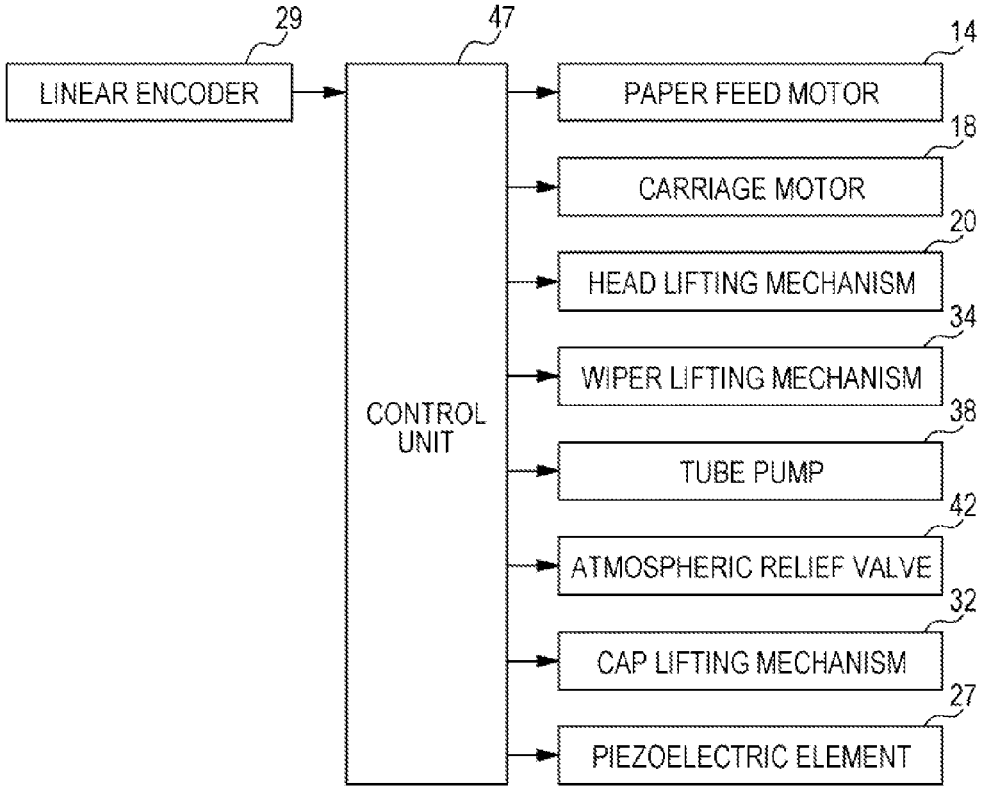
FIG. 4 is a block diagram illustrating an electrical configuration of the printer.

As illustrated in FIG. 4, the ink jet-type printer 11 (refer to FIG. 1) is provided with a control unit 47 for collectively controlling the ink jet-type printer 11. An input side interface (not illustrated) of the control unit 47 is electrically connected to the linear encoder 29. Furthermore, the control unit 47 grasps the position of the carriage 16 on the basis of an electrical signal output from the linear encoder 29.

On the other hand, an output side interface (not illustrated) of the control unit 47 is electrically connected to the paper feed motor 14, the carriage motor 18, the head lifting mechanism 20, the wiper lifting mechanism 34, the tube pump 38, the atmospheric relief valve 42, the cap lifting mechanism 32, and the piezoelectric element 27, respectively. Furthermore, the control unit 47 controls the driving of the paper feed motor 14, the carriage motor 18, the head lifting mechanism 20, the wiper lifting mechanism 34, the tube pump 38, the atmospheric relief valve 42, the cap lifting mechanism 32, and the piezoelectric element 27, respectively.

Next, an operation of the maintenance mechanism 50 will be described.

Meanwhile, as illustrated in FIG. 2, when the cleaning is performed with respect to the liquid ejecting head 19, first, the cap 30 is lifted while the carriage 16 is moved to the home position region, and thus comes in contact with the nozzle forming surface 22 of the liquid ejecting head 19 through the cover head 24 in order to cover the respective nozzles 21.

Subsequently, when the tube pump 38 is driven, the inside of the cap 30 is sucked, and thus comes to have a negative pressure. According to this negative pressure, the thickened ink in each of the nozzles 21 is discharged along with air bubbles into the waste ink tank 37 through the inside of the cap 30, the discharge passage 35*a*, and the inside of the discharge tube 36, and the cleaning is ended. At this time, the ink is adhered to the nozzle forming surface 22 and the cover head 24.

Then, after the cleaning is ended, that is, after suction of the ink from each of the nozzles 21 of the liquid ejecting head 19 is ended, the tube pump 38 is driven while the atmospheric relief valve 42 opens, so that air suction which discharges residual ink inside the cap 30 is performed. Accordingly, the ink absorbed and stored in the liquid absorber 44 is discharged from the discharge passage 35*a* along with the air which has flowed from the atmospheric relief passage 41*a* into the cap 30. After the air suction is ended, the cap 30 is lowered, and thus is separated from the nozzle forming surface 22 of the liquid ejecting head 19.

Subsequently, the wiping which sweeps away the ink adhered to the nozzle forming surface 22 and the cover head 24 by the wiper 33 is performed. When this wiping is performed, first, the liquid ejecting head 19 is moved in the vertical direction as an example of the second direction which is a direction intersecting with the nozzle forming surface 22, thereby allowing the height of the liquid ejecting head 19 to be adjusted such that the interference amount of the nozzle forming surface 22 and the wiper 33 in the vertical direction is a first interference amount. At this time, the wiper 33 is stopped.

Here, when the nozzle forming surface 22 and the wiper 33 do not come in contact with each other through the cover head 24 in the vertical direction, the interference amount of the nozzle forming surface 22 and the wiper 33 in the vertical direction (the second direction) indicates an overlapping amount of the liquid ejecting head 19 and the wiper 33 in the horizontal direction (the first direction) which is a direction along the nozzle forming surface 22. In addition, when the nozzle forming surface 22 and the wiper 33 come in contact with each other through the cover head 24 in the vertical direction, the interference amount of the nozzle forming surface 22 and the wiper 33 in the vertical direction indicates a bending amount of the wiper 33.

Figure 5:
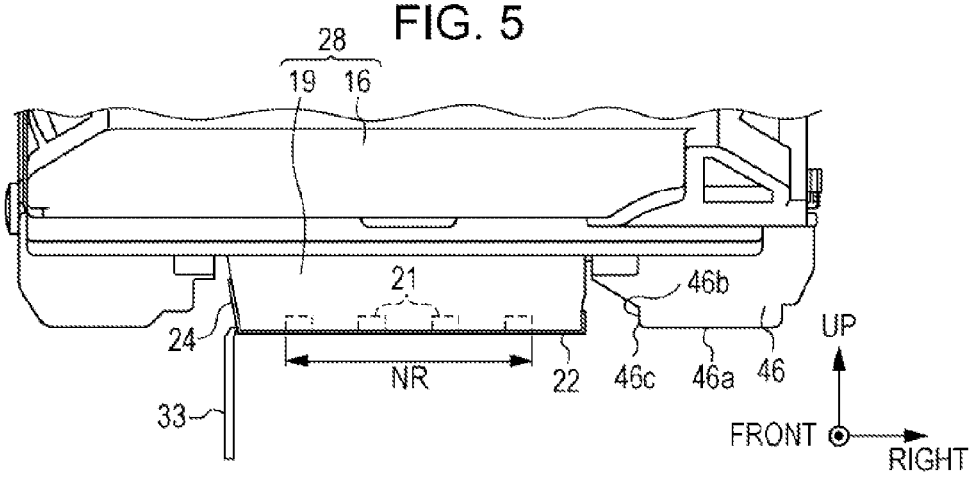
FIG. 5 is a schematic view illustrating a state in which a wiper comes in contact with a left side surface of a liquid ejecting head of the printer through a cover head.

Subsequently, the carriage 16 is moved to the left side which is the printing region side for performing the printing from the right side which is the home position region side while the wiper 33 is stopped. Then, as illustrated in FIG. 5, the upper end portion of the wiper 33 comes in contact with the left side surface of the liquid ejecting head 19 through the cover head 24. At this time, the interference amount of the nozzle forming surface 22 and the wiper 33 in the vertical direction in the position of the wiper 33 which comes in contact with the left side surface of the liquid ejecting head 19 through the cover head 24 is the first interference amount.

Figure 6:
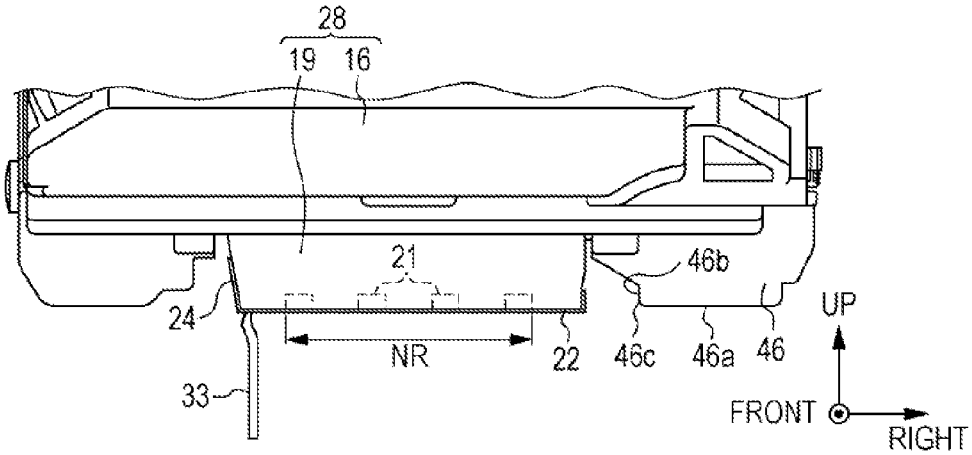
FIG. 6 is a schematic view illustrating a state in which the wiper comes in contact with a left end of a nozzle forming surface of the liquid ejecting head through the cover head in a first interference amount.

Subsequently, when the carriage 16 is moved to the left side while the wiper 33 is stopped, as illustrated in FIG. 6, the wiper 33 comes in contact with the nozzle forming surface 22 between the left end (one end) and the nozzle region NR thereof through the cover head 24 while being bent in order to be slightly curved to the left side. Subsequently, after the carriage 16 is stopped, the liquid ejecting head 19 is lowered such that the interference amount of the nozzle forming surface 22 and the wiper 33 in the vertical direction is a second interference amount which is greater than the first interference amount.

Figure 7:
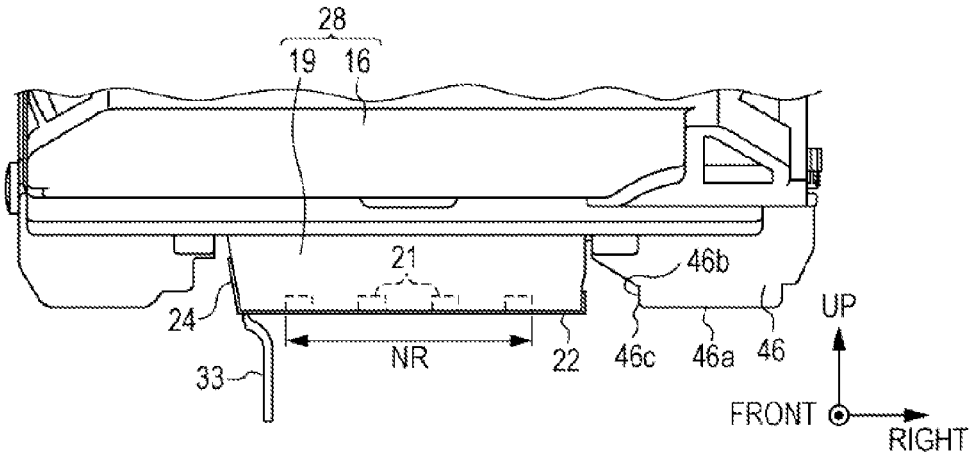
FIG. 7 is a schematic view illustrating a state in which the wiper comes in contact with the left end of the nozzle forming surface of the liquid ejecting head through the cover head in a second interference amount.
Figure 8:
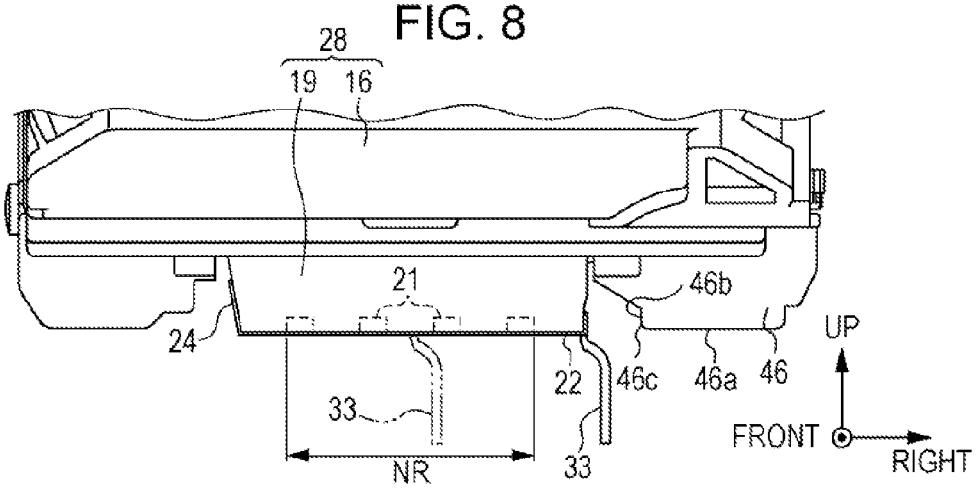
FIG. 8 is a schematic view illustrating a state in which the liquid ejecting unit is moved such that the wiper is moved from the left end of the nozzle forming surface to a right end while coming in contact with the nozzle forming surface of the liquid ejecting head through the cover head in the second interference amount.

Then, as illustrated in FIG. 7, the bending amount of the wiper 33 increases. Subsequently, when the carriage 16 is moved to the left side while the wiper 33 is stopped, as illustrated in FIG. 8, the wiper 33 is relatively moved to the right end (the other end) from the left end (the one end) of the nozzle forming surface 22 along the horizontal direction.

Accordingly, the cover head 24 and the nozzle region NR of the nozzle forming surface 22 is wiped by the wiper 33. At this time, the ink adhered to the cover head 24 and the nozzle forming surface 22 is captured by the wiper 33, and an ink meniscus of each of the nozzles 21 is aligned by the wiper 33.

Figure 9:
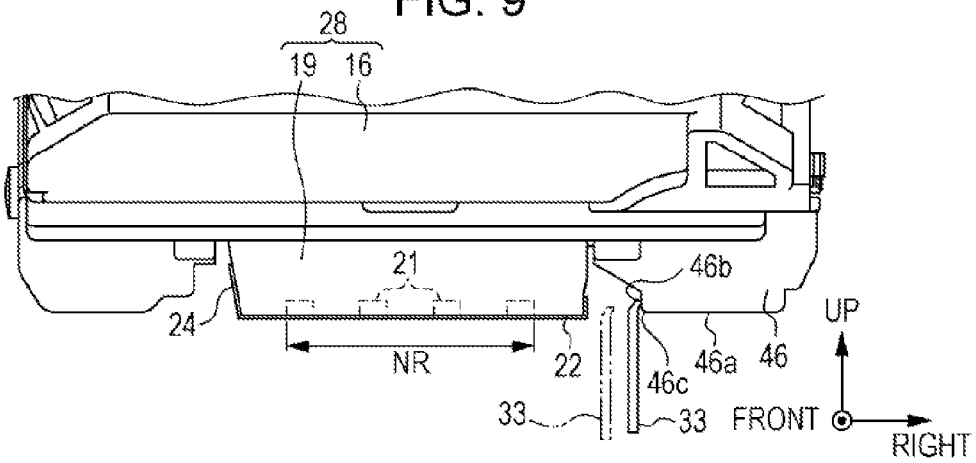
FIG. 9 is a schematic view illustrating a state in which the wiper is lifted between the liquid ejecting head and a scraping unit.

Subsequently, when the carriage 16 is moved to the left side while the wiper 33 is stopped, as illustrated in FIG. 9, the wiper 33 passes through the right end (the other end) of the nozzle forming surface 22. Furthermore, when the wiper 33 is relatively moved to a position (a position illustrated by a two-dot chain line of FIG. 9) between the right end (the other end) of the nozzle forming surface 22 and the scraping unit 46, the carriage 16 is stopped.

Subsequently, the wiper 33 is lifted such that the interference amount of the nozzle forming surface 22 and the wiper 33 in the vertical direction is a third interference amount which is greater than the second interference amount. Subsequently, when the carriage 16 is moved to the left side while the wiper 33 is stopped, as illustrated in FIG. 9, the wiper 33 is relatively moved to a position (a position illustrated by a solid line of FIG. 9) where the upper end portion of the wiper 33 comes in contact with the scraping surface 46*b* of the scraping unit 46.

Figure 10:
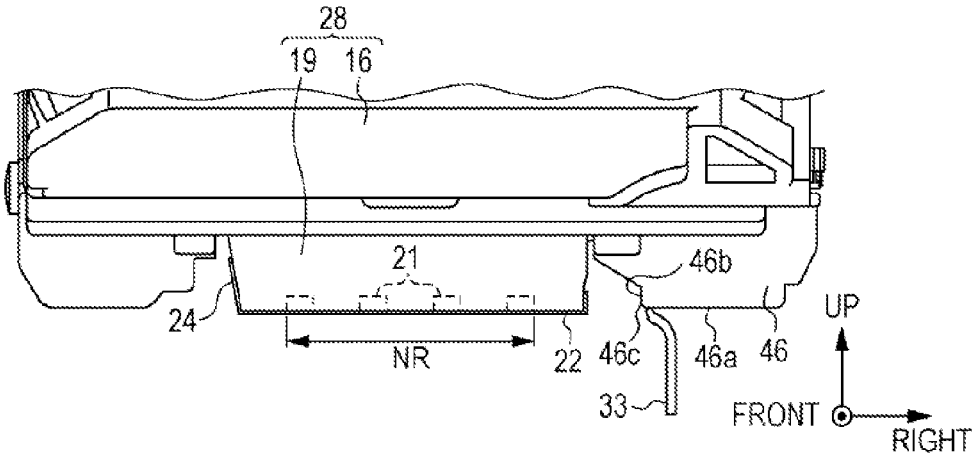
FIG. 10 is a schematic view illustrating a state in which ink adhered to the wiper is scraped off by the scraping unit.

Subsequently, when the carriage 16 is moved to the left side while the wiper 33 is stopped, as illustrated in FIG. 10, the wiper 33 is relatively moved to the lower surface 46*a* of the scraping unit 46 while being bent in order for the upper end portion of the wiper 33 to be slightly curved to the left side. At this time, since the upper end portion of the wiper 33 is stroked by the corner portion 46*c* of the scraping unit 46, the ink captured in the upper end portion of the wiper 33 is rubbed by the scraping surface 46*b*. That is, the ink captured in the wiper 33 is scraped by the scraping unit 46, and removed from the wiper 33. After that, the carriage 16 is moved to the printing region, and the printing is started.

Thus, when the wiping is performed with respect to the nozzle forming surface 22 by the wiper 33, the interference amount of the nozzle forming surface 22 and the wiper 33 in the vertical direction of a case where the upper end portion of the wiper 33 comes in contact with the left side surface of the liquid ejecting head 19 through the cover head 24 is smaller than the interference amount of a case where the nozzle region NR is wiped by the wiper 33. That is, the first interference amount is smaller than the second interference amount. For this reason, it is possible to effectively wipe the nozzle region NR of the nozzle forming surface 22 by the wiper 33, while the ink adhered to the wiper 33 is inhibited from being adhered to the side portion of the cover head 24 or the liquid ejecting head 19.

In addition, when the ink captured in the wiper 33 is scraped off by the scraping unit 46, the third interference amount which is an interference amount of the nozzle forming surface 22 and the wiper 33 in the vertical direction is greater than the second interference amount which is an interference amount of the nozzle forming surface 22 and the wiper 33 in the vertical direction when the nozzle region NR is wiped by the wiper 33. For this reason, it is possible to effectively scrape off and collect the ink captured in the wiper 33 by the scraping unit 46.

As described above, according to the embodiment described above, it is possible to obtain the following effects.

(1) Since the interference amount of the wiper 33 and the nozzle forming surface 22 in the position of the wiper 33 which comes in contact with the left side surface of the liquid ejecting head 19 through the cover head 24 is the first interference amount which is smaller than the second interference amount, it is possible to inhibit the wiper 33 from being stroked by the cover head 24 in the position of the wiper 33 which comes in contact with the liquid ejecting head 19 through the cover head 24. For this reason, the ink adhered to the wiper 33 is able to be inhibited from being adhered to the side portion of the cover head 24 or the liquid ejecting head 19. On the other hand, since the interference amount of the wiper 33 and the nozzle forming surface 22 in the nozzle region NR of the nozzle forming surface 22 is the second interference amount which is greater than the first interference amount, it is possible to effectively wipe the nozzle forming surface 22 by the wiper 33. Therefore, it is possible to effectively wipe the nozzle forming surface 22 by the wiper 33, while the ink adhered to the wiper 33 is inhibited from being adhered to the side portion of the cover head 24 or the liquid ejecting head 19.

(2) The interference amount of the wiper 33 and the nozzle forming surface 22 in the vertical direction is changed from the first interference amount to the second interference amount which is greater than the first interference amount, between the left end and the nozzle region NR of the nozzle forming surface 22 in the horizontal direction. For this reason, in particular, it is possible to effectively wipe the nozzle region NR of the nozzle forming surface 22 by the wiper 33.

(3) The interference amount of the wiper 33 and the nozzle forming surface 22 in the vertical direction is changed to the third interference amount which is greater than the second interference amount, between the right end of the nozzle forming surface 22 and the scraping unit 46 in the horizontal direction. For this reason, since a contact amount of the wiper 33 and the scraping unit 46 becomes larger, it is possible to effectively scrape off and collect the ink adhered to the wiper 33 by the scraping unit 46.

(4) The operation for changing the interference amount of the wiper 33 and the nozzle forming surface 22 in the vertical direction from the first interference amount to the second interference amount which is greater than the first interference amount, between the left end and the nozzle region NR of the nozzle forming surface 22 in the horizontal direction, is performed while the carriage 16 is stopped. For this reason, it is possible to change the interference amount of the wiper 33 and the nozzle forming surface 22 from the first interference amount to the second interference amount with high accuracy.

MODIFICATION EXAMPLE

Furthermore, the embodiment described above may be modified as following.

The operation for changing the interference amount of the wiper 33 and the nozzle forming surface 22 in the vertical direction from the first interference amount to the second interference amount which is greater than the first interference amount, between the left end and the nozzle region NR of the nozzle forming surface 22 in the horizontal direction, may be performed while the carriage 16 is moved.

The interference amount of the wiper 33 and the nozzle forming surface 22 in the vertical direction may not be changed to the third interference amount which is greater than the second interference amount, between the right end of the nozzle forming surface 22 and the scraping unit 46 in the horizontal direction.

The operation for changing the interference amount of the wiper 33 and the nozzle forming surface 22 in the vertical direction to the third interference amount which is greater than the second interference amount, between the right end of the nozzle forming surface 22 and the scraping unit 46 in the horizontal direction, may be performed while the carriage 16 is moved.

The position for changing the interference amount of the wiper 33 and the nozzle forming surface 22 in the vertical direction from the first interference amount to the second interference amount which is greater than the first interference amount, is not necessarily between the left end and the nozzle region NR of the nozzle forming surface 22 in the horizontal direction. For example, the interference amount of the wiper 33 and the nozzle forming surface 22 in the vertical direction may be changed from the first interference amount to the second interference amount in the nozzle region NR.

When the nozzle forming surface 22 is wiped by the wiper 33, the wiper 33 may be moved from the left side to the right side while the liquid ejecting unit 28 is stopped, and the wiper 33 may be moved from the left side to the right side while the liquid ejecting unit 28 is moved from the right side to the left side.

When the interference amount of the wiper 33 and the nozzle forming surface 22 is changed, the wiper 33 may be lifted while the liquid ejecting head 19 is stopped, and the wiper 33 may be lifted while the liquid ejecting head 19 is lifted.

The cover head 24 may be omitted.

The liquid ejecting head 19 may be a so-called stationary line head-type liquid ejecting head, instead of the reciprocating liquid ejecting head which is reciprocated by the carriage 16.

A supply source of the ink which is the liquid ejected from the liquid ejecting head 19 is not limited to the ink cartridge 26 provided in the carriage 16, it may be an ink container provided in the main body case 12 which is outside the carriage 16, or an ink container provided outside the main body case 12.

In the embodiment described above, the liquid ejecting apparatus may be a liquid ejecting apparatus for ejecting or discharging liquid other than the ink. Furthermore, examples of a state of the liquid discharged from the liquid ejecting apparatus in the form of a droplet of a minute amount may include being granular, being tear-shaped, and being knotted thread-shaped. In addition, the liquid described herein may be a material which is able to be ejected from the liquid ejecting apparatus. For example, it may be in a state where a substance is in a liquid phase, and may include fluids such as a liquid with a high or low viscosity, a sol, gel water, other inorganic solvents, organic solvents, a solution, a liquid resin, and a liquid metal (metallic melt). In addition, a state of the substance is not limited to liquid, and it may include a state where particles of a solid functional material such as a pigment or a metallic particle are dissolved in, dispersed in, or mixed into a solvent. A representative example of the liquid includes the ink described in the embodiment described above, a liquid crystal, or the like. Here, the ink includes various liquid compositions such as general water-based ink and oil-based ink, gel ink, and hot-melt ink. Specific examples of the liquid ejecting apparatus include a liquid ejecting apparatus for ejecting liquid in a state where a material such as an electrode material or a color material which is used in manufacturing, for example a liquid crystal display, an electroluminescence (EL) display, a surface-emitting display, or a color filter is dispersed or dissolved therein. In addition, it may be a liquid ejecting apparatus for ejecting a bioorganic substance used in manufacturing a biochip, a liquid ejecting apparatus used as a precision pipette for ejecting liquid sample, a textile printer, a micro dispenser, or the like. Further, it may be a liquid ejecting apparatus for ejecting lubricant oil to a precision machine such as a watch or a camera with a pinpoint, and a liquid ejecting apparatus for ejecting a transparent resin solution such as an ultraviolet cured resin for forming a micro half-sphere lens (an optical lens) or the like used in an optical communication element or the like onto a substrate. In addition, it may be a liquid ejecting apparatus for ejecting etching liquid such as an acid or an alkali for etching a substrate or the like.

The entire disclosure of Japanese Patent Application No. 2013-158649, filed Jul. 31, 2013 is expressly incorporated by reference herein.

What is claimed is:

1. A liquid ejecting apparatus comprising:

a liquid ejecting unit which includes a nozzle forming surface having nozzle openings for ejecting liquid formed thereon;

a wiper which is contactably disposed on the nozzle forming surface;

a first movement unit which is able to relatively move the liquid ejecting unit and the wiper in a first direction along the nozzle forming surface;

a second movement unit which is able to relatively move the liquid ejecting unit and the wiper in a second direction intersecting with the nozzle forming surface; and a control unit which controls the first movement unit and the second movement unit, wherein the control unit controls the first movement unit such that the wiper comes in contact with the nozzle forming surface after coming into contact with a side of the liquid ejecting unit, and the wiper is relatively moved from one end to the other end of the nozzle forming surface in the first direction while the wiper comes in contact with the nozzle forming surface, and the control unit controls the second movement unit such that a first interference amount which is an interference amount of the wiper and the nozzle forming surface in the second direction in a position of the wiper which comes in contact with the side of the liquid ejecting unit, is smaller than a second interference amount which is an interference amount of the wiper and the nozzle forming surface in the second direction when the wiper is relatively moved through a nozzle region which is a region including the nozzle openings of the nozzle forming surface in the first direction.

2. The liquid ejecting apparatus according to claim 1, wherein the control unit controls the second movement unit such that the interference amount of the wiper and the nozzle forming surface in the second direction is changed from the first interference amount to the second interference amount, between the one end and the nozzle region of the nozzle forming surface in the first direction.

3. The liquid ejecting apparatus according to claim 1, further comprising:

a scraping unit which is disposed in the other end side of the nozzle forming surface of the liquid ejecting unit away from the nozzle forming surface in the first direction to scrape off the liquid adhered to the wiper by coming in contact with the wiper, wherein the control unit controls the first movement unit such that the wiper is relatively moved to the scraping unit side in the first direction after the wiper passes through the other end of the nozzle forming surface in the first direction, and the control unit controls the second movement unit such that the interference amount of the wiper and the nozzle forming surface in the second direction is changed to a third interference amount which is greater than the second interference amount, between the other end of the nozzle forming surface and the scraping unit in the first direction.

4. The liquid ejecting apparatus according to claim 1, wherein the control unit controls the first movement unit such that relative movement of the liquid ejecting unit and the wiper in the first direction is stopped, between the one end and the nozzle region of the nozzle forming surface in the first direction, and then the control unit controls the second movement unit such that the interference amount of the wiper and the nozzle forming surface in the second direction is changed from the first interference amount to the second interference amount.

5. A wiping method in which a liquid ejecting unit including a nozzle forming surface having nozzle openings for ejecting liquid formed thereon and a wiper are relatively moved to wipe the nozzle forming surface by sliding the wiper and the nozzle forming surface, wherein a first interference amount which is an interference amount of the wiper and the nozzle forming surface in a position of the wiper which comes in contact with a side of the liquid ejecting unit before coming in contact with the nozzle forming surface, is smaller than a second interference amount which is an interference amount of the wiper and the nozzle forming surface when the wiper and a nozzle region which is a region including the nozzle openings of the nozzle forming surface are slid.

6. The wiping method according to claim 5, wherein the first interference amount is changed to the second interference amount, between one end and the nozzle region of the nozzle forming surface in a direction along the nozzle forming surface.

7. The wiping method according to claim 5, wherein a scraping unit is disposed in the other end side of the nozzle forming surface of the liquid ejecting unit away from the nozzle forming surface in a direction along the nozzle forming surface to scrape off the liquid adhered to the wiper by coming in contact with the wiper, the wiper is relatively moved to the scraping unit side in the direction along the nozzle forming surface after the wiper passes through the other end of the nozzle forming surface in the direction along the nozzle forming surface, and the interference amount of the wiper and the nozzle forming surface is changed to a third interference amount which is greater than the second interference amount, between the other end of the nozzle forming surface and the scraping unit in the direction along the nozzle forming surface.

8. The wiping method according to claim 5, wherein relative movement of the liquid ejecting unit and the wiper is stopped, between the one end and the nozzle region of the nozzle forming surface in the direction along the nozzle forming surface, and then the first interference amount is changed to the second interference amount.

9. The liquid ejecting apparatus according to claim 1, wherein the movement of the liquid ejecting unit in the second direction causes the first and second interference amounts.

* * * * *